US005775120A

United States Patent [19]

Inazuka et al.

[11] Patent Number: 5,775,120

[45] Date of Patent: Jul. 7, 1998

[54] COMPACT AIR CONDITIONER OUTDOOR UNIT HAVING HIGH HEAT EXCHANGING ABILITY

[75] Inventors: Toru Inazuka; Mitsuhisa Nagao; Takahiro Takenaka, all of Osaka, Japan

[73] Assignee: Daikin Industries, Ltd., Osaka, Japan

[21] Appl. No.: 817,866

[22] PCT Filed: Sep. 3, 1996

[86] PCT No.: PCT/JP96/02480

§ 371 Date: Apr. 23, 1997

§ 102(e) Date: Apr. 23, 1997

[87] PCT Pub. No.: WO97/10477

PCT Pub. Date: Mar. 20, 1997

[30] Foreign Application Priority Data

Sep. 14, 1995 [JP] Japan ..... 7-236900
Jun. 12, 1996 [JP] Japan ..... 8-150907

[51] Int. Cl.[6] ..... F24F 5/00

[52] U.S. Cl. ..... 62/259.1; 62/428; 62/298

[58] Field of Search ..... 62/259.1, 267, 62/296, 298, 404, 428

[56] References Cited

U.S. PATENT DOCUMENTS

| | | | |
|---|---|---|---|
| 4,132,088 | 1/1979 | Grosskopf | 62/298 |
| 4,138,859 | 2/1979 | Pietsch | 62/324 |
| 4,475,585 | 10/1984 | Hoeffken | 165/134 R |
| 4,736,598 | 4/1988 | Sameshima et al. | 62/259.1 |
| 5,582,026 | 12/1996 | Barto | 62/298 |
| 5,619,863 | 4/1997 | Kil | 62/428 |

FOREIGN PATENT DOCUMENTS

| | | | |
|---|---|---|---|
| 55-118562 | 9/1980 | Japan . | |
| 58-69768 | 5/1983 | Japan . | |
| 69768 | 5/1983 | Japan . | |
| 58-135664 | 9/1983 | Japan . | |
| 1-60128 | 4/1989 | Japan . | |
| 60128 | 4/1989 | Japan . | |
| 1-260241 | 10/1989 | Japan . | |
| 260241 | 10/1989 | Japan . | |
| 2-71029 | 3/1990 | Japan . | |
| 71029 | 3/1990 | Japan . | |
| 2-96532 | 8/1990 | Japan . | |
| 3-164634 | 7/1991 | Japan . | |
| 405196263 | 8/1993 | Japan | 62/259.1 |
| 406241503 | 8/1994 | Japan | 62/259.1 |
| 6-63655 | 8/1994 | Japan . | |

*Primary Examiner*—William Doerrler

[57] ABSTRACT

An air conditioner outdoor unit is made to be compacted and achieve a reduced noise level and a reduced installation space. A U-shaped heat exchanger 3 is provided so that it encloses a cross flow fan 2. A heat exchange unit 1A including the cross flow fan 2 and the heat exchanger 3 is arranged in an upper position and a machine room unit 1B including a compressor 5 is arranged in a lower position so that they are integrated into one body with a casing 7 having an identical cross section shape. A fan motor 4 and a shut-off valve 21 are provided at the upper end of the casing 7, by which an outdoor unit having an upright thin slim structure including a top joint structure capable of arranging piping in the upper position is provided.

13 Claims, 10 Drawing Sheets

COMPACT AIR CONDITIONER OUTDOOR UNIT HAVING HIGH HEAT EXCHANGING ABILITY

TECHNICAL FIELD

The present invention relates to an outdoor unit of a separate type air conditioner of which indoor unit and outdoor unit are connected with each other by means of piping.

BACKGROUND ART

A prior art air conditioner outdoor unit has been generally constructed by a heat exchange unit and a machine room unit, the heat exchange unit having a heat exchanger bent in a L-like shape in a generally box-shaped casing, and a propeller fan at a rear surface side corner portion of the heat exchanger, and the machine room unit having a compressor and electric components adjacently on a side of the heat exchange unit via a partition wall.

There is another outdoor unit employing a cross flow fan in place of the propeller fan.

In the outdoor unit employing a cross flow fan, an approximately L-shaped heat exchanger extending from a front surface side to one side surface side is provided in a casing, a cross flow fan is provided on the other side portion side to form a lateral wind passage for taking in air from an air inlet formed at the one side portion side of the casing and discharging the air through an air outlet formed at the other side portion side, and a machine room is further provided at a rear surface side of the air passage via a partition wall (Japanese patent publication No. HEI 6-63655).

In yet another outdoor unit, a heat exchanger having a flat configuration is provided only at a front surface side of a casing, and a cross flow fan is provided behind the heat exchanger with interposition of a scroll section so as to discharge air blown from the cross flow fan through an air outlet formed at the side of a casing (Japanese Patent Laid-Open Publication No. SHO 55-118562).

However, there is a limitation in compacting any of the above prior arts, and if it is attempted to compact the outdoor unit itself, it causes a disadvantage that the heat exchange area itself of the heat exchanger is inevitably reduced in accordance with the compact and the air delivery capacity of the fan is reduced, thus lowering the heat exchanging ability.

There is another one in which a heat exchange unit and a machine room unit are simply stacked vertically to provide a slim configuration. However, according to such a simple vertical stack configuration achieved without changing the structures of the unit sections, its dimensions in the lateral direction and the depthwise direction can be reduced in outline in comparison with the aforementioned prior arts. However, it extends only in the vertical direction, and any further achievement in slimming and thinning of the configuration is impossible. Furthermore, if it is attempted to adopt a top joint structure capable of easily performing a pipe connecting work in the same construction, there emerges another problem of how to arrange in an upper place a communication pipe (refrigerant pipe) extending from the machine room at the lower side.

Accordingly, it is an object of the present invention to provide an air conditioner outdoor unit which has a high heat exchanging ability and a compact configuration capable of allowing its installation area to be reduced.

Another object of the present invention is to provide an air conditioner outdoor unit capable of reducing its installation space and achieving an improved stability and an improved aesthetic performance in the installed state.

DISCLOSURE OF THE INVENTION

The present invention provides an air conditioner outdoor unit comprising a compressor, a heat exchanger and a fan, wherein the heat exchanger is arranged on the periphery of the fan and bent substantially in a U-like or J-like shape so that it encloses a specified portion of the fan.

According to the above construction, the heat exchanger is bent in a U-like or J-like shape so as to enclose the specified portion of the fan, and therefore, it is allowed to be totally compacted as far as possible while securing a sufficient heat exchange area. Therefore, the whole outdoor unit is compacted and made thin.

Furthermore, the specified portion of the fan is enclosed by the heat exchanger bent in a U-like or J-like shape, and therefore, the flow of air taken in on driving the fan passes through the whole heat exchanger efficiently uniformly, thereby further improving the heat exchanging ability.

According to one embodiment, the heat exchanger has a plurality of plate fins of which surfaces are parallel to a rotary shaft of the fan, and the plurality of plate fins are arranged substantially radially relative to the fan.

With this arrangement, when the rotary shaft of the fan is provided upright, water drops attached to the plate fins are guided along the surfaces of the plate fins to smoothly fall off. Therefore, the water drops do not spatter.

According to one embodiment, an air inlet is provided on a heat exchanger surface side opposite to a surface of the heat exchanger facing the fan, and an air outlet is provided in a place that is located on the periphery of the fan and is not enclosed by the heat exchanger.

According to one embodiment, the fan is a cross flow fan.

With this arrangement, the required air flow rate can be easily obtained by providing a sufficient length in the vertical direction of the cross flow fan.

The same effect as above can be also implemented by, for example, coaxially connecting a plurality of sirocco fans.

According to one embodiment, an air discharge passage is implemented by a scroll section, and a piping space is formed on the rear surface side of the scroll.

By virtue of the piping space, the piping can be made easy and compact.

According to one embodiment, the compressor and a heat exchange unit having the fan and the heat exchanger are stacked with each other vertically in two tiers.

With this arrangement, the installation space of the outdoor unit is reduced.

According to one embodiment, a heat exchange unit having the heat exchanger and the fan is arranged with the compressor horizontally adjacently to each other.

With this arrangement, the stability of the outdoor unit is improved in the installed state.

According to one embodiment, a scroll for forming an air discharge passage extending from the fan to an outlet is further provided, and an end portion of the heat exchanger extends so that it faces a rear surface of an inlet side portion of the scroll.

With this arrangement, a part of intake air passes through the extended end portion of the heat exchanger, and therefore, the ability of the heat exchanger improves.

According to one embodiment, the heat exchange unit is arranged at an upper side of a machine room unit having the compressor, a shut-off valve is provided at an upper portion of the heat exchange unit, and a communication pipe extending from the machine room unit is connected to the shut-off valve through a piping space provided on a rear surface side of an air discharge passage of the heat exchange unit.

According to one embodiment, a shut-off valve is provided at an upper portion of the heat exchange unit located horizontally adjacently to the compressor, and a communication pipe extending from the compressor is connected to the shut-off valve through a piping space on a rear surface side of the air discharge passage of the heat exchange unit.

With this arrangement, a top joint structure capable of easily performing a pipe connecting work can be easily achieved without dimensionally increasing the outdoor unit nor exposing the piping to the outside of the casing. Therefore, the operator is allowed to perform the pipe connecting work from the front side in a standing posture, and an area required for an installation work of the side surface can be reduced.

According to one embodiment, a motor for the fan is provided at the upper portion of the heat exchange unit having the heat exchanger and the fan, the air outlet is opened obliquely upwardly, and air outlet louvers are arranged in parallel with one another in a direction along the direction of the opening at the air outlet.

With this arrangement, the louvers can be easily placed, and air discharged by the upwardly directed louvers is directed upward, so that the limitation that a space of a certain dimension is necessary on the front surface side or on the side surface side can be eliminated. Furthermore, since the air outlet and the louvers are arranged obliquely upwardly, the possible short-circuiting of outgoing discharge air to the inlet side can be prevented and the discharged air scarcely blows on human beings at a veranda or the like. Furthermore, an installation limit distance from the outdoor unit to an obstacle in front can be reduced.

According to one embodiment, a piping space is formed on a rear surface side of an air discharge passage extending from the air inlet to the air outlet.

With this arrangement, when, for example, the heat exchange unit and the machine room unit are stacked with each other with the former arranged at the upper side and the latter arranged at the lower side, a variety of communication pipes such as the refrigerant pipe of the compressor of the machine room unit located at the lower side can be easily arranged over the heat exchange unit at the upper side utilizing the piping space.

According to one embodiment, a machine room unit having the compressor is provided, and the machine room unit and the heat exchange unit are vertically stacked with each other and stored in a casing having a substantially identical transverse cross section shape to be integrated with each other.

With this arrangement, the heat exchange unit itself can be compacted further than in the prior art having the mere vertical stack structure. On the other hand, the machine room unit is mainly comprised of the compressor, and therefore, it can be innately sufficiently compacted in the vertical, lateral and depthwise directions.

Therefore, by vertically stacking the two units with each other with either one of them arranged at the upper side and storing them in a casing having an identical cross section shape to integrate them into one body, an outdoor unit which is much slimmer and thinner than any prior art can be constructed.

That is, the fan such as the cross flow fan and the heat exchanger come to have a relation such that they can be compactly stored, the whole outdoor unit can be designed to have a compact thin slim structure. As a result, the limitation on the installation space is reduced and the installation work can be made easier.

Furthermore, when, among the heat exchange unit and the machine room unit that are stacked vertically with, for example, either one of them arranged at the upper side, the machine room unit is made to serve as a general use base and the heat exchange unit is made replaceable, the heat exchanging ability and an air flow capacity can be varied by merely changing the heat exchange unit.

According to one embodiment, the fan is a cross flow fan, a casing having a back plate and a front plate which are arranged opposite to each other and a pair of right and left side plates which are arranged between the back plate and the front plate is provided, a cross flow fan is arranged inside the casing with its axial direction directed in the vertical direction, a scroll extending from the cross flow fan toward a corner portion between one side plate and the front plate of the casing is arranged on the periphery of a discharge side of the cross flow fan, and the compressor is arranged in a corner space section which is enclosed by three members of a side plate and a back plate of the casing and the scroll, extends vertically in the casing and has an approximately triangular cross section shape.

With the above arrangement, paying attention to the unused space in the casing, or the corner space section that is enclosed by the side plate, the back plate and the scroll, extends vertically in the casing and has an approximately triangular cross section shape, the compressor is placed inside the corner space section. Therefore, the compressor can be arranged inside the casing adjoining the cross flow fan and the heat exchanger. With this arrangement, in comparison with, for example, the prior art in which the compressor is arranged below the cross flow fan and the heat exchanger, the height dimension of the casing, or the height dimension of the outdoor unit can be suppressed low that much because no vertical space for placing the compressor inside the casing is required to be secured.

As a result, while keeping the advantage of reducing the installation space in the horizontal planar direction characteristic of the upright type outdoor unit employing the cross flow fan, a reduction of the installation space in the vertical direction can be concurrently achieved, thereby allowing the whole outdoor unit to be further compacted. Furthermore, by a degree corresponding to the reduction in height dimension of the casing, the stability of the outdoor unit in regard to its external appearance is improved in the installed state, and this consequently improves the commercial value of the outdoor unit.

According to one embodiment, a shut-off valve is provided at an upper portion of the heat exchange unit having the heat exchanger and the fan, and a duct for allowing a pipe to pass therethrough is connected to an upper portion of the casing for storing the heat exchange unit and the compressor.

With this arrangement, the piping is concealed by the slim duct to allow an improved outward appearance to be achieved.

According to one embodiment, a shut-off valve is provided at an upper portion of the heat exchange unit having the heat exchanger and the fan, a casing for storing the heat exchange unit and the compressor and an extension casing having a transverse cross section shape identical to that of the casing are provided, the casing and the extension casing are vertically connected with each other, and a pipe is arranged through the extension casing.

With this arrangement, the casing and the extension casing fill the space between the floor surface and the eaves while stretching between them, so that the outdoor unit can be prevented from tumbling. Furthermore, since the piping can be concealed by the extension casing, the outward appearance of the outdoor unit can be improved.

BRIEF DESCRIPTION OF THE DRAWINGS

BEST MODE FOR CARRYING OUT THE INVENTION (First Embodiment) FIGS. 1 through 8 show the construction, performance and a variety of installation states of an air conditioner outdoor unit according to a first embodiment of the present invention.

First of all, FIGS. 1 through 5 show the construction of the whole body and the essential part of the outdoor unit.

Figure 1:
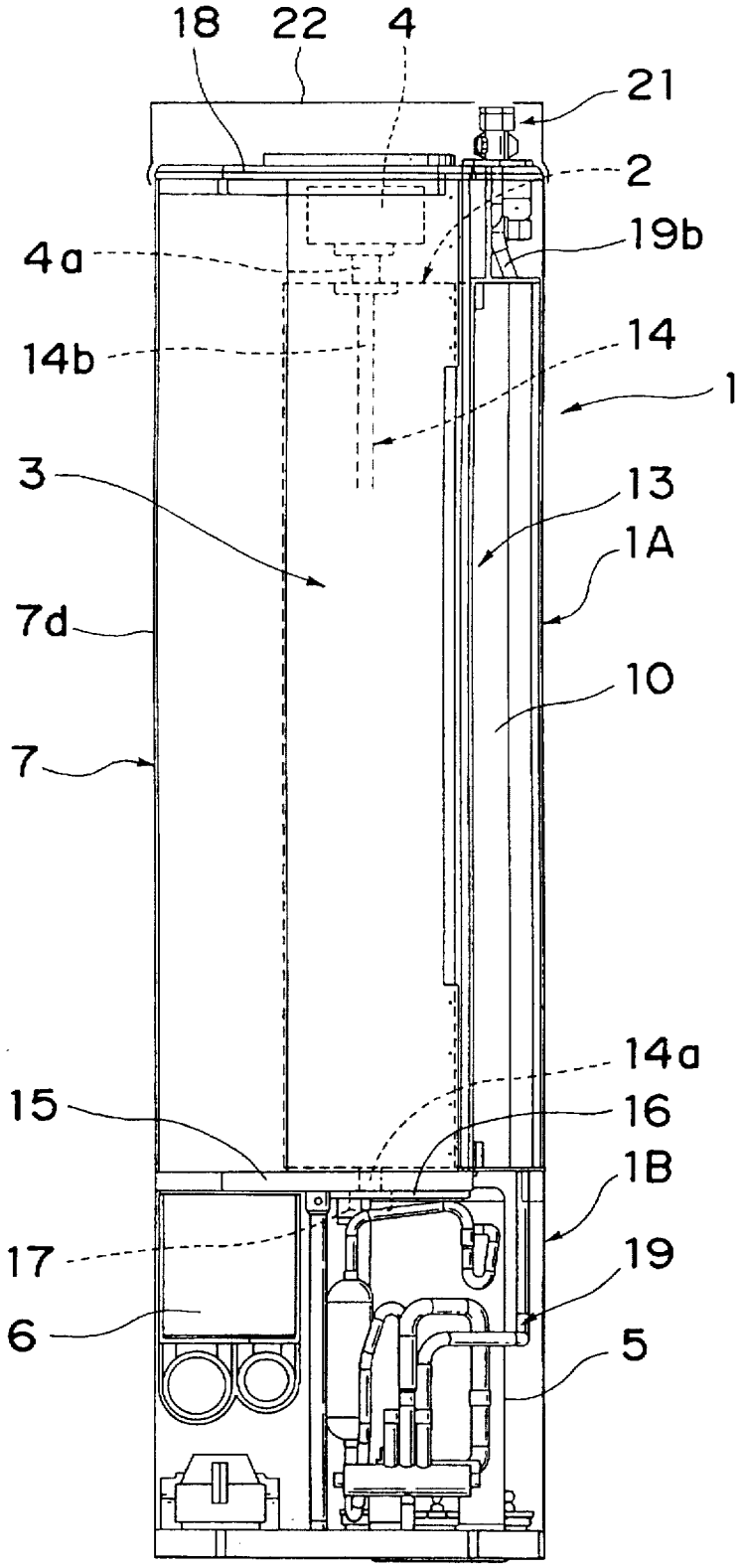
FIG. 1 is a schematic front view of an air conditioner outdoor unit with a part of its casing removed according to a first embodiment of the present invention.

In these figures, the reference numeral 1 denotes the outdoor unit. The outdoor unit 1 is comprised of a heat exchange unit 1A that is placed in an upper position and provided with a cross flow fan 2, a heat exchanger 3, a fan motor 4 and so forth, and a machine room unit 1B that is placed in a lower position and provided with a compressor 5, various electric components 6 and so forth. These two units 1A and 1B are vertically stacked with each other and thereafter integrated into one body to be stored in a cassette type casing 7 having an identical cross section shape (refer to FIG. 4), so that the integrated body is formed in a vertically elongated thin slim structure as a whole.

Figure 4:
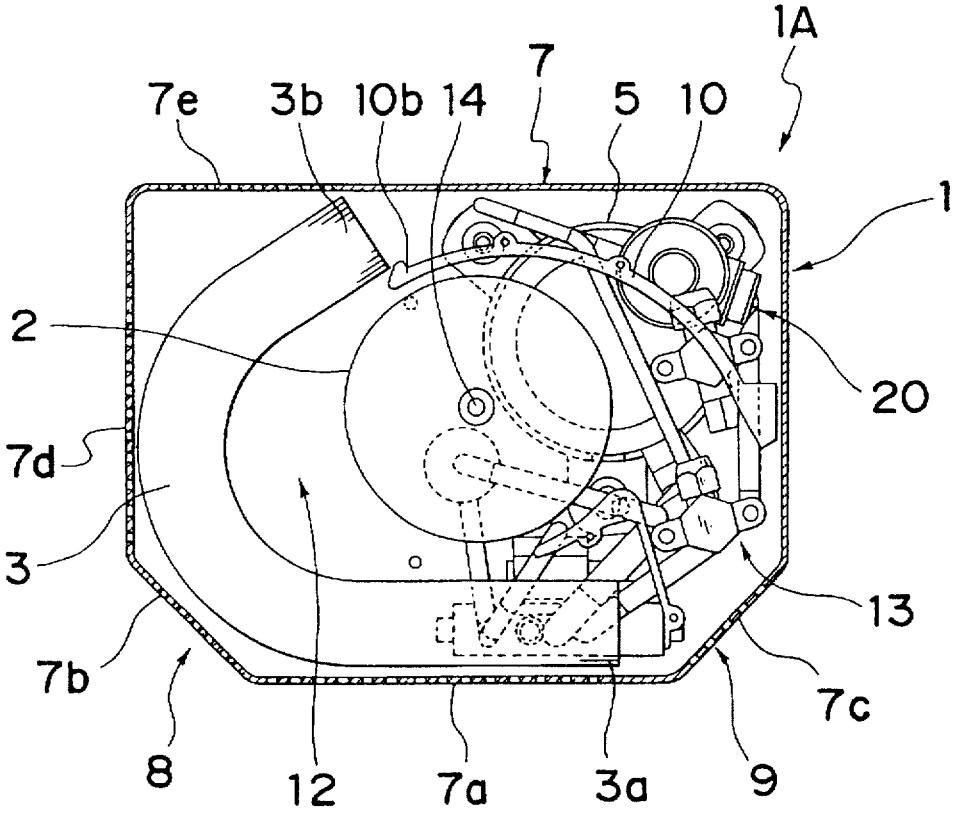
FIG. 4 is a schematic transverse sectional view of the above outdoor unit viewed from above with the bottom wall and the like of its heat exchange unit removed.

As shown in FIG. 4, the casing 7 of the outdoor unit 1 has its front surface center portion formed in a flat surface 7*a*, and right and left hand portions of the flat surface 7*a* is tapered toward a rear surface to be formed into first and second tapered surfaces 7*b* and 7*c*.

Figure 5:
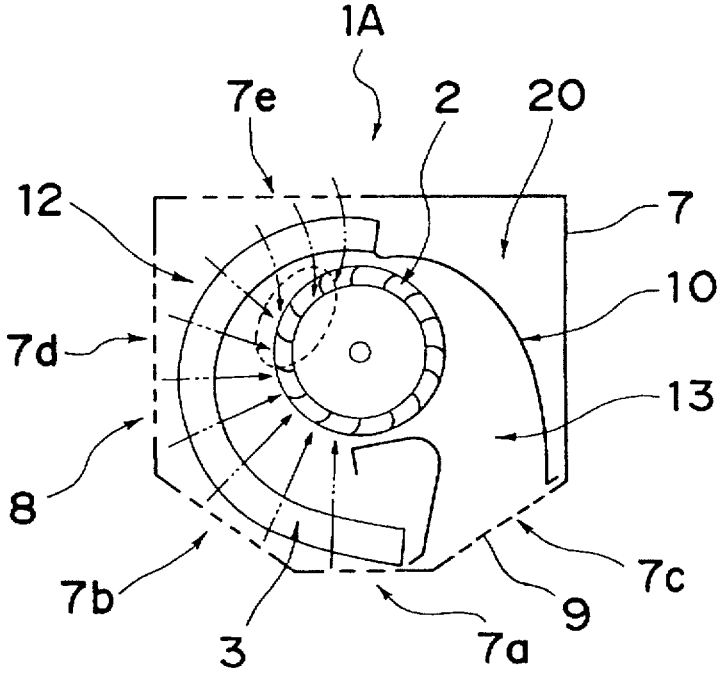
FIG. 5 is an explanatory view of the operation of the essential part of the above outdoor unit.

Then, at the location of the heat exchange unit 1A, as shown in FIGS. 4 and 5, a portion extending from the front side flat surface 7*a* via the left hand tapered surface 7*b*, a left side surface 7*d* to a rear side leftward surface 7*e* of the casing 7 is formed in an air suction grill section 8 corresponding to the peripheral surface of the heat exchanger 3 while a front side rightward surface 7*c* is formed in an air discharge grill section 9 corresponding to an air discharge passage 13.

Then, in a space section inside the air suction grill section 8 formed as extended from the front side flat surface 7*a* via the left hand first tapered surface 7*b*, the left side surface 7*d* to the rear side leftward surface 7*e* of the casing 7 is provided the heat exchanger 3 that is bent sectionally in an approximately U-like shape so that it extends in the bending directions of the surfaces.

Furthermore, inside the casing 7 is provided a scroll section 10 that extends in a paraboloidal shape from inside the air discharge grill section 9 formed at the front surface side rightward surface 7*c* to a hind end portion 3*b* of the heat exchanger 3 located closer to the center portion of the rear surface of the casing 7. Inside the scroll section 10 is formed an air discharge passage 13 that is provided for the cross flow fan 2 and extends from a downstream portion of the heat exchanger 3 to the air discharge grill section 9. The air discharge passage 13 is communicated with an air suction passage 12 inside the air suction grill section 8 via the heat exchanger 3. Then, on the rear surface side of the scroll section 10 that defines the air discharge passage 13 is formed a piping space 20 in which a refrigerant pipe (communication pipe) 19 (refer to FIG. 2) for the compressor 5 is inserted and extended in a vertical direction.

Figure 3:
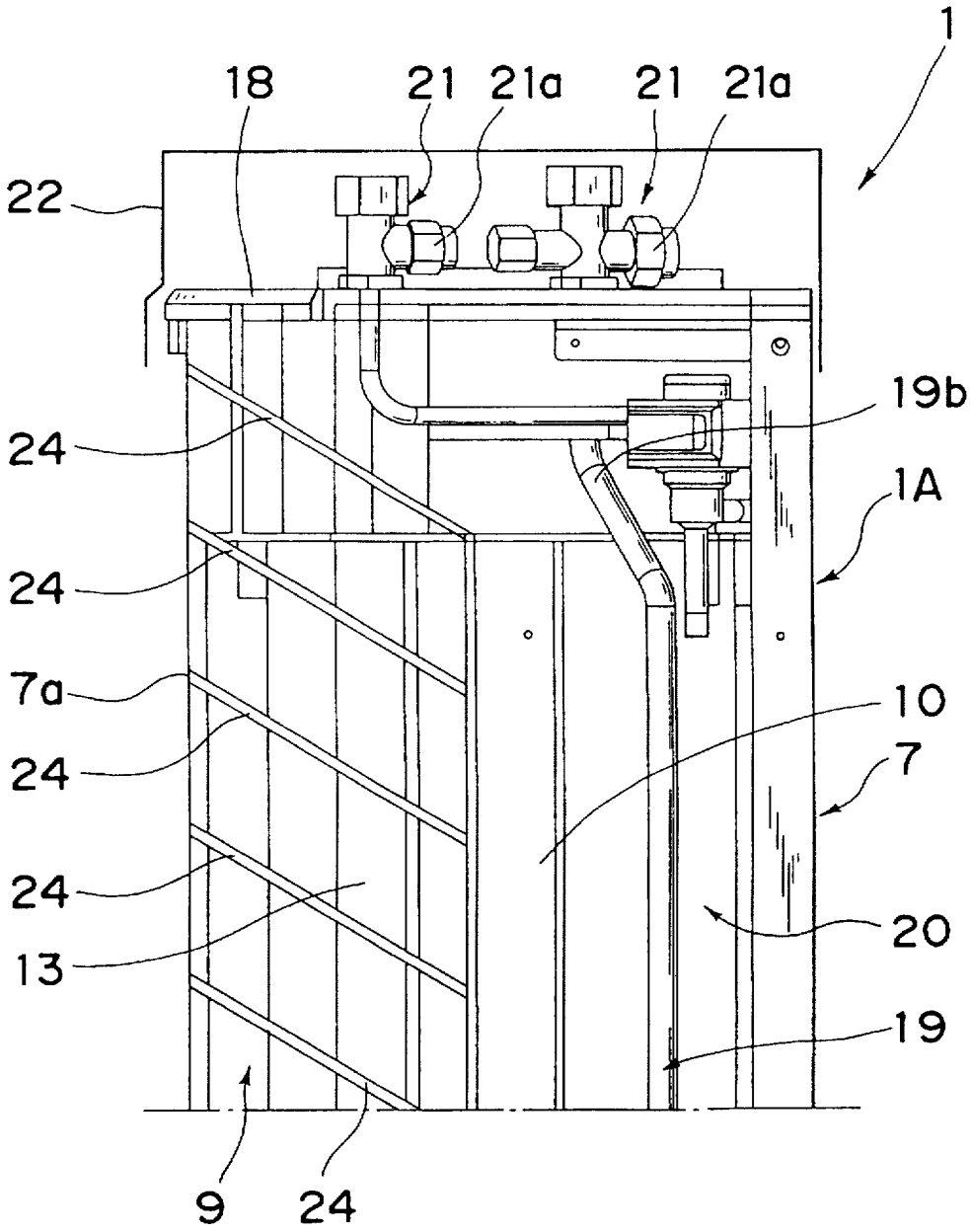
FIG. 3 is a schematic enlarged right side view of the essential part of the above outdoor unit.

Furthermore, as shown in FIG. 1, at an upper portion of the heat exchange unit 1A is provided a fan motor 4. On the other hand, as shown in FIG. 3, an air outlet extended to the air discharge grill section 9 is opened obliquely upwardly, while air outlet louvers 24, 24, that extend in the direction of the opening are arranged in parallel with one another at the air outlet utilizing a dead space formed by arranging the fan motor 4 at the upper portion of the heat exchange unit 1A.

Then, the cross flow fan 2 is arranged between both fore and hind end portions 3*a* and 3*b* of the sectionally U-shaped heat exchanger 3, in the vicinity of an extension end lob extended from the air discharge grill section 9 side of the scroll section 10 and closer to the hind end portion 3*b* of the heat exchanger 3. As shown in FIG. 1, the cross flow fan 2 is made operable by rotatably supporting a lower end 14*a* of its rotary shaft 14 on a bearing 17 provided as fixed on a support wall 16 (not shown in FIG. 4) on the ceiling side of the machine room unit 1B through a bottom wall 15 (not shown in FIG. 4) of the heat exchange unit 1A of the casing 7 and connecting an upper end 14*b* of the rotary shaft 14 to a drive shaft 4*a* of the fan motor 4 provided as fixed on a lower surface of a ceiling wall 18 at the heat exchange unit 1A side of the casing 7.

Therefore, when the fan motor 4 is driven, the cross flow fan 2 is rotated by the fan motor 4, and as shown in FIGS. 4 and 5, the outside air is taken in from the air suction grill section 8, so that the outside air is discharged to the outside from the air discharge grill section 9 through the air suction passage 12, the heat exchanger 3, the cross flow fan 2 and the air discharge passage 13 while undergoing efficient heat exchange.

Figure 6:
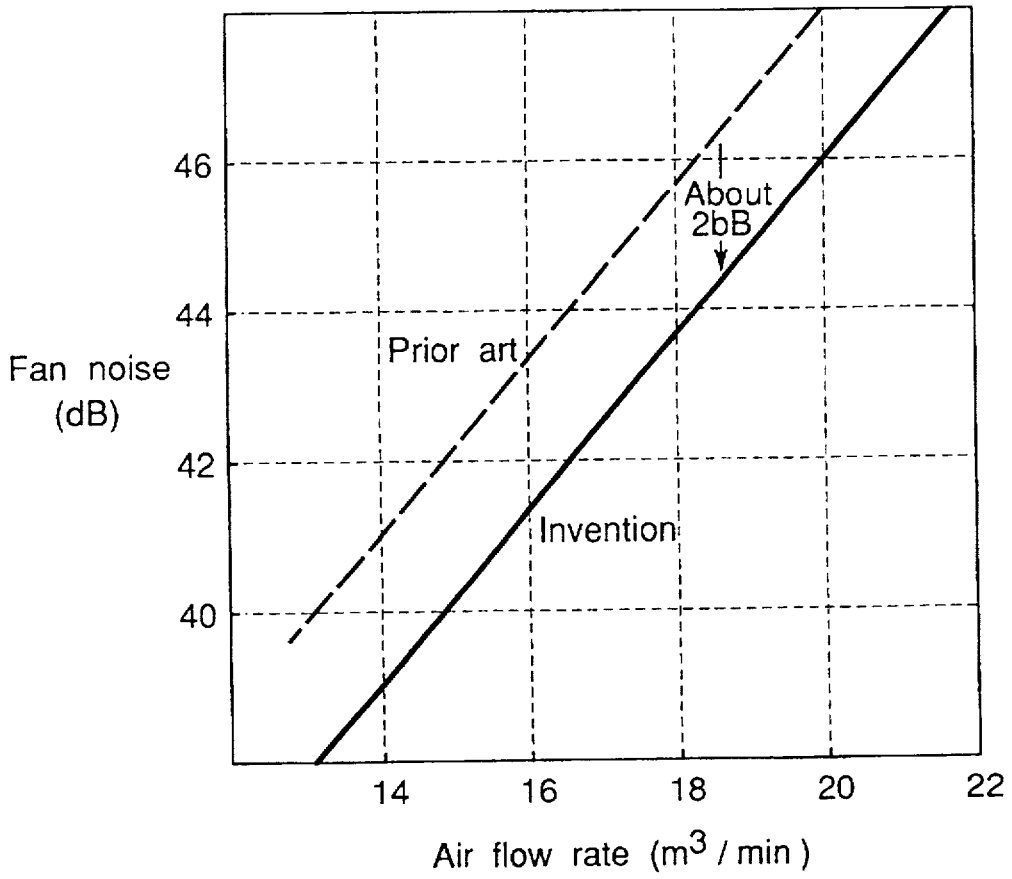
FIG. 6 is a characteristic chart showing a comparison of a noise reduction characteristic of the above outdoor unit with that of a prior art.

In the present case, according to the above construction, as the result that the cross flow fan 2 is arranged closer to the hind end portion 3*b* of the heat exchanger 3 in the vicinity of the upstream end 10*b* of the scroll section 10, the flow of air flowing into the cross flow fan 2 is made opposite to the fan blades as shown in FIG. 5, and therefore, a reduced fan noise results as shown in FIG. 6.

Figure 2:
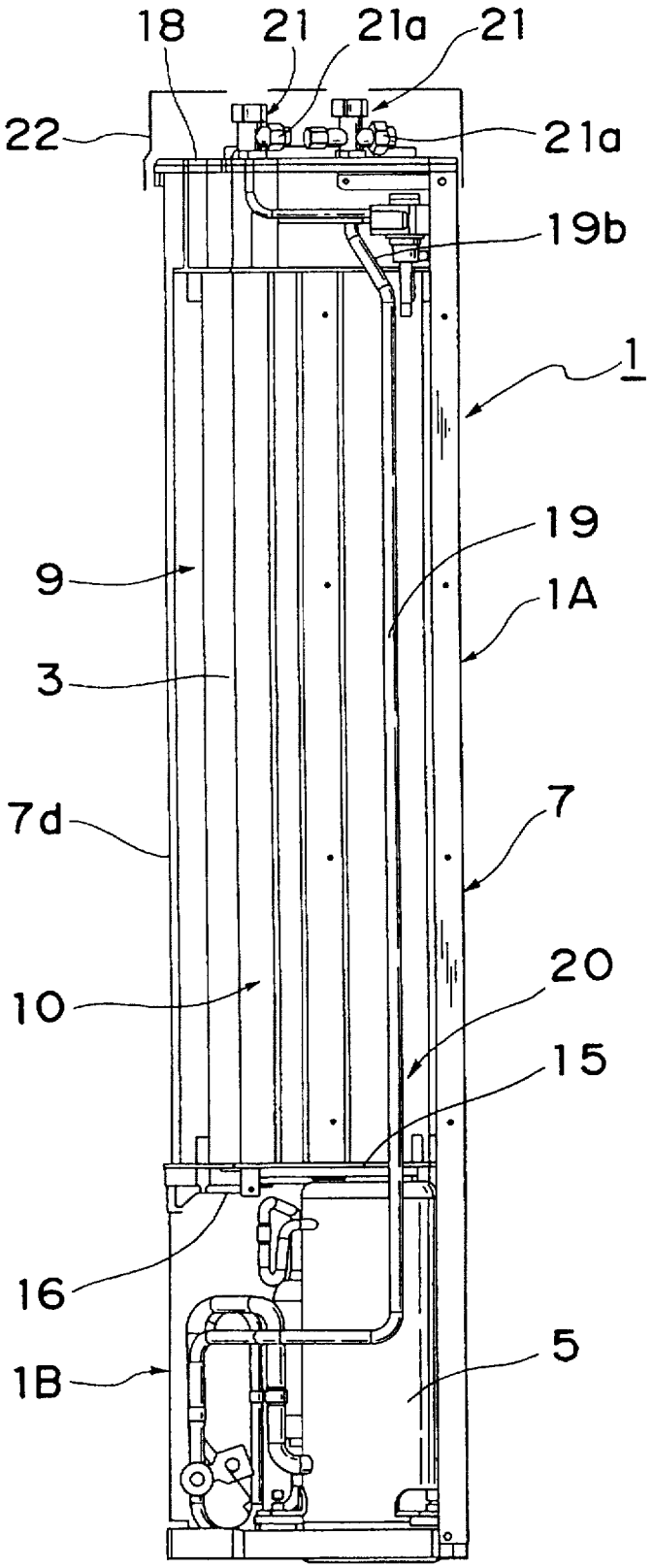
FIG. 2 is a schematic right side view of the above outdoor unit.
Figure 7:
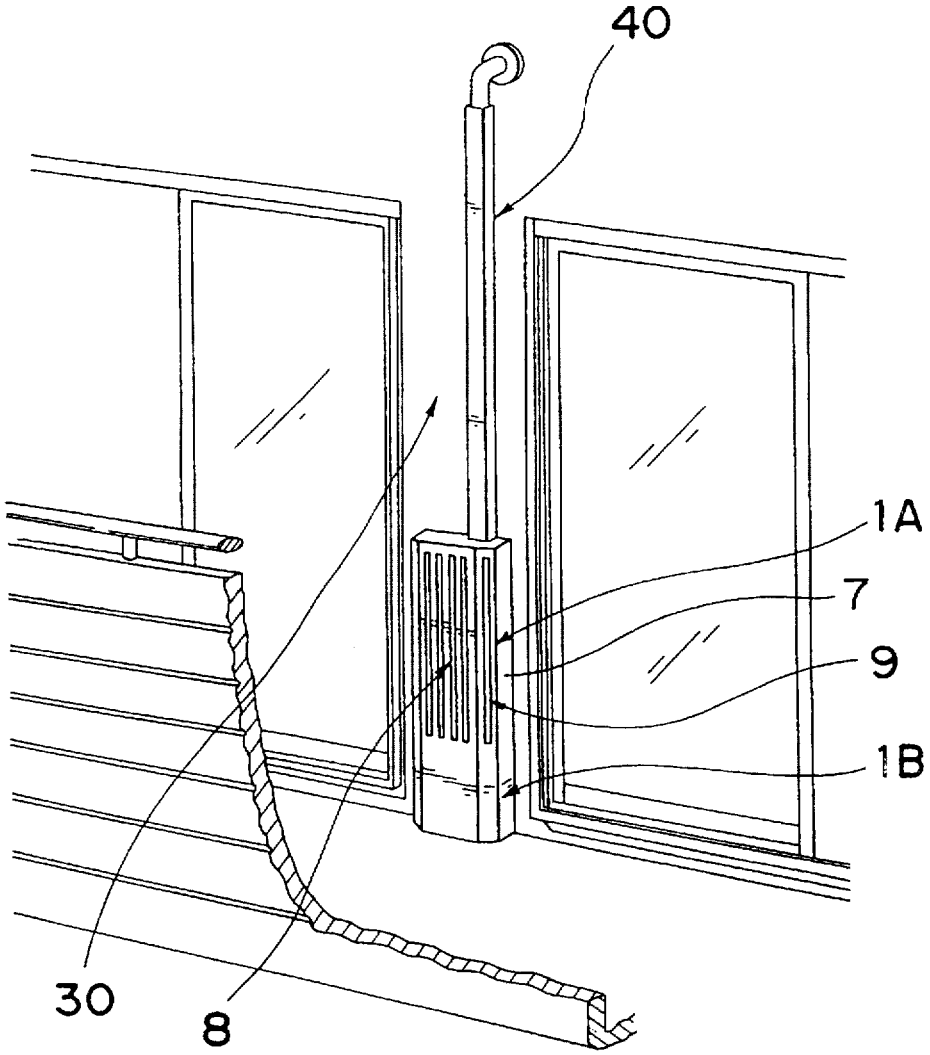
FIG. 7 is a view of an example of the actual installation state of the above outdoor unit.
Figure 8:
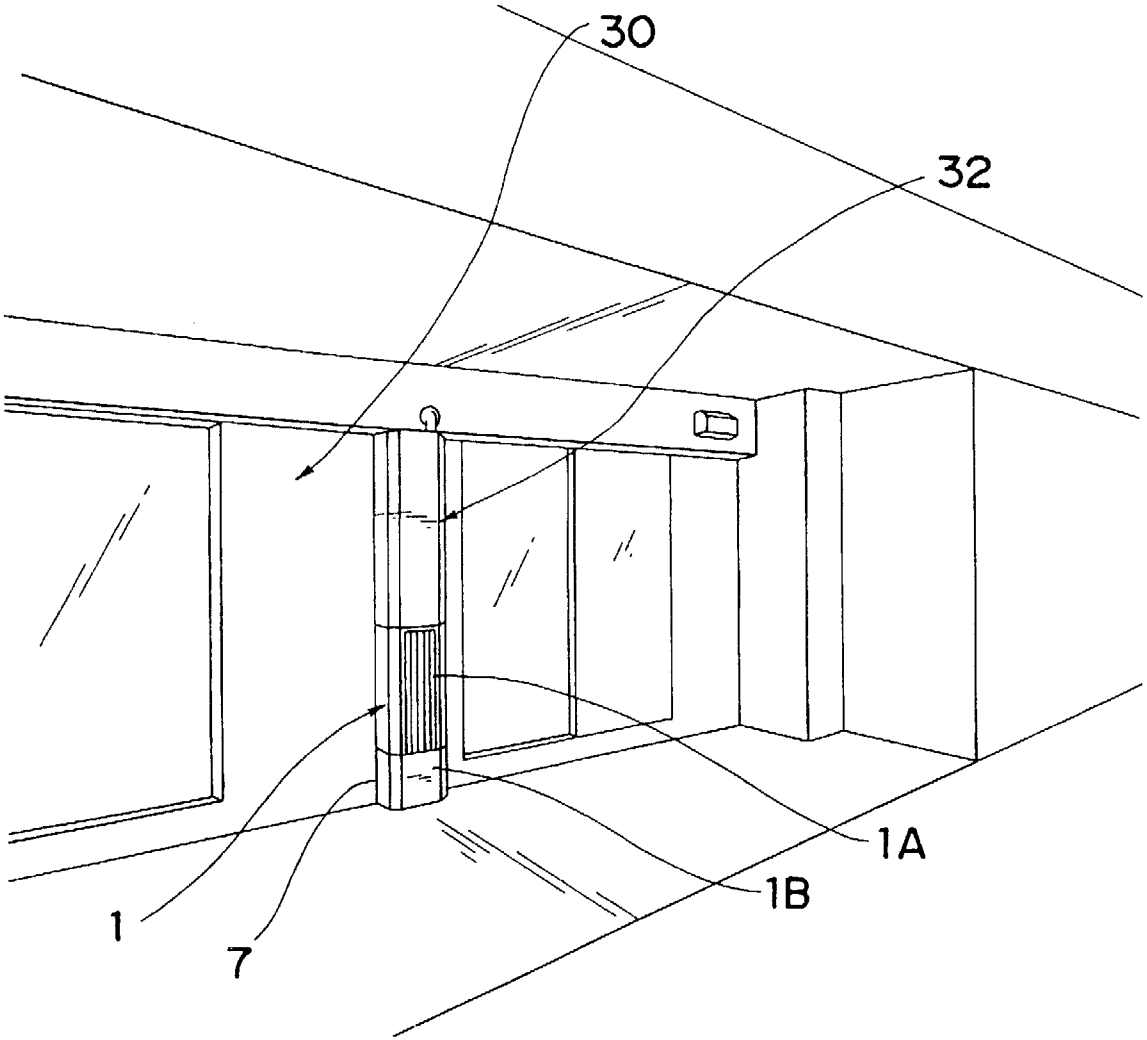
FIG. 8 is a view of another example of the actual installation state of the above outdoor unit.

On the other hand, a reference numeral 19 in FIGS. 1, 2 and 3 denotes a refrigerant pipe (communication pipe) extending from the compressor 5 side. The refrigerant pipe 19 extends upwardly utilizing the piping space 20 formed on the rear surface side of the scroll section 10 at the heat exchange unit 1A side and upwardly penetrates the ceiling wall 18 at the heat exchange unit 1A side of the casing 7. At its extended end portion **19*b* is formed a top joint structure provided with a shut-off valve 21. Then, it is connected to the heat exchange unit 1A of the indoor unit 1 via the shut-off valve 21 in an installation state as shown in FIG. 7 or FIG. 8**.

In the above construction, as shown in FIGS. 1, 2 and 3, on the ceiling section 18 of the casing 7 at the heat exchange unit 1A side is removably fitted a cover 22 having approximately same cross section shape as that of the casing 7, so that the shut-off valve 21 itself is concealed to be externally invisible. Further, the reference numeral **21*a* denotes an operating section 21*a* of the shut-off valve 21**.

As described above, the outdoor unit 1 of the air conditioner of the present embodiment has the heat exchange unit 1A as one characteristic part, the heat exchange unit having the heat exchanger 3 that is bent in a U-like shape and encloses approximately half of the cross flow fan 2 located at the center.

With the above arrangement, the heat exchanger 3 is allowed to be totally compacted as far as possible and secure a sufficient heat exchange area, so that the heat exchange unit 1A comprised of the cross flow fan 2, the heat exchanger 3, the fan motor 4 and so forth is compacted.

Consequently, the heat exchange unit 1A comprised of the cross flow fan 2 and the heat exchanger 3 can be compactly stored in the casing 7, so that the whole outdoor unit 1 can be designed to be compact and slim.

As a result, the limitation on the installation space is reduced, and an installation work is made easier.

Furthermore, approximately half of the cross flow fan 2 is enclosed by the heat exchanger 3 bent in a U-like shape, and therefore, an intake air flow produced upon driving the cross flow fan 2 is allowed to pass through the heat exchanger 3 efficiently and uniformly, thereby further improving the heat exchanging ability. Furthermore, the relation of the cross flow fan 2 to its scroll section 10 and the heat exchanger 3 is as shown in FIG. 5 in the above case, and therefore, the fan noise is remarkably reduced further than in the prior art structure as shown in the graph of FIG. 6.

Furthermore, according to the above construction, the outdoor unit 1 is separated into the two units of the heat exchange unit 1A having the cross flow fan 2 and the heat exchanger 3 and the machine room unit 1B having the compressor 5, the electric components 6 and so forth, while the units are stacked with each other with the heat exchange unit 1A placed at the upper side and the machine room unit 1B placed at the lower side and stored in the casing 7 having an identical cross section shape to be integrated with each other.

With the above arrangement, firstly the heat exchange unit 1A itself placed at the upper side can be compacted much further than in the aforementioned case of the prior art mere vertical stack structure. Further, the machine room unit 1B placed at the lower side is mainly comprised of the compressor 5 and the electric components 6, and therefore, it can be innately sufficiently compacted.

Therefore, by vertically stacking them and storing them in the casing 7 having the identical cross section shape to integrate them into one body, an outdoor unit that is much slimmer and thinner than the prior art mere vertical stack structure can be constructed.

In this case, among the heat exchange unit 1A and the machine room unit 1B that are vertically stacked with each other, by designing the heat exchange unit 1A to be replaceable while the machine room unit 1B is used as a general use base section, the heat exchanging ability and the air flow capacity can be varied by merely changing the heat exchange unit 1A.

It is also acceptable to place the heat exchange unit in the lower position and place the machine room unit in the upper position.

Furthermore, according to the above construction, the piping space 20 is provided on the rear surface side of the scroll section 10 that is forming the air discharge passage 13 extending from the air inlet portion of the cross flow fan 2 to the air discharge grill section 9 in the vertical stack structure as described above.

Therefore, a variety of pipes such as the refrigerant pipe of the compressor 5 of the machine room unit 1B placed at the lower side can be arbitrarily arranged by utilizing the piping space 20.

Then, according to the above construction, the shut-off valve 21 is further provided at the upper portion of the heat exchange unit 1A placed at the upper side, and the refrigerant pipe 19 of the machine room unit 1B placed at the lower side is connected to the shut-off valve 21 located at the upper portion of the heat exchange unit 1A through the piping space 20 having a space margin on the rear surface side of the scroll section 10 of the heat exchange unit 1A placed at the upper side.

As a result, the top joint structure is easily achieved without dimensionally increasing the outdoor unit 1 nor exposing the piping to the outside of the casing 7.

With the above arrangement, the operator is allowed to perform the pipe connecting work from the front surface side in a standing posture, and the space for an installation work on the side surface can be reduced.

Furthermore, according to the above construction, the fan motor 4 is provided at the upper portion of the heat exchange unit 1A, the air outlet to the air discharge grill section 9 is opened obliquely upwardly, and the air outlet louvers 24, 24, . . . that extend in the direction of the opening are arranged in parallel with one another at the air outlet utilizing the dead space formed by arranging the fan motor 4 at the upper portion of the heat exchange unit 1A.

As a result, the air outlet louvers 24, 24, . . . can be easily placed, and air discharged by the upwardly directed air outlet louvers 24, 24, . . . is directed upward, so that the possible short-circuiting to the inlet side can be prevented and no limitation is imposed on the front or side surface.

Furthermore, the discharged air scarcely blows on human beings at a veranda or the like.

Furthermore, according to the above construction, the fan is implemented by the cross flow fan 2, and therefore, the required air flow rate can be easily obtained by providing a sufficient length in the vertical direction. An effect similar to the above can be also produced by, for example, coaxially connecting a plurality of sirocco fans.

Then, the air conditioner outdoor unit 1 having the above construction can be installed in a smart state with an excellent outward appearance as tightly fitted to a wall 30 of a veranda or the like of an apartment house using a slim duct 40 as shown in FIG. 7 by taking advantage of its slim thin top joint configuration.

Furthermore, as shown in FIG. 8, the outdoor unit 1 itself is placed in the lower position, and an extension casing 32 having the same cross section shape as that of the casing 7 is extended to a position under the eaves, thereby achieving a smart casing structure elongated vertically from the floor surface to the position under the eaves. Through the extension casing 32 is arranged a piping.

With this arrangement, the slim duct 40 as shown in FIG. 7 is eliminated to provide a better outward appearance. Furthermore, by virtue of the provision of the extension casing 32, the space between the floor surface and the eaves is filled, and therefore, the outdoor unit 1 is prevented from tumbling.

(Second Embodiment)

Figure 9:
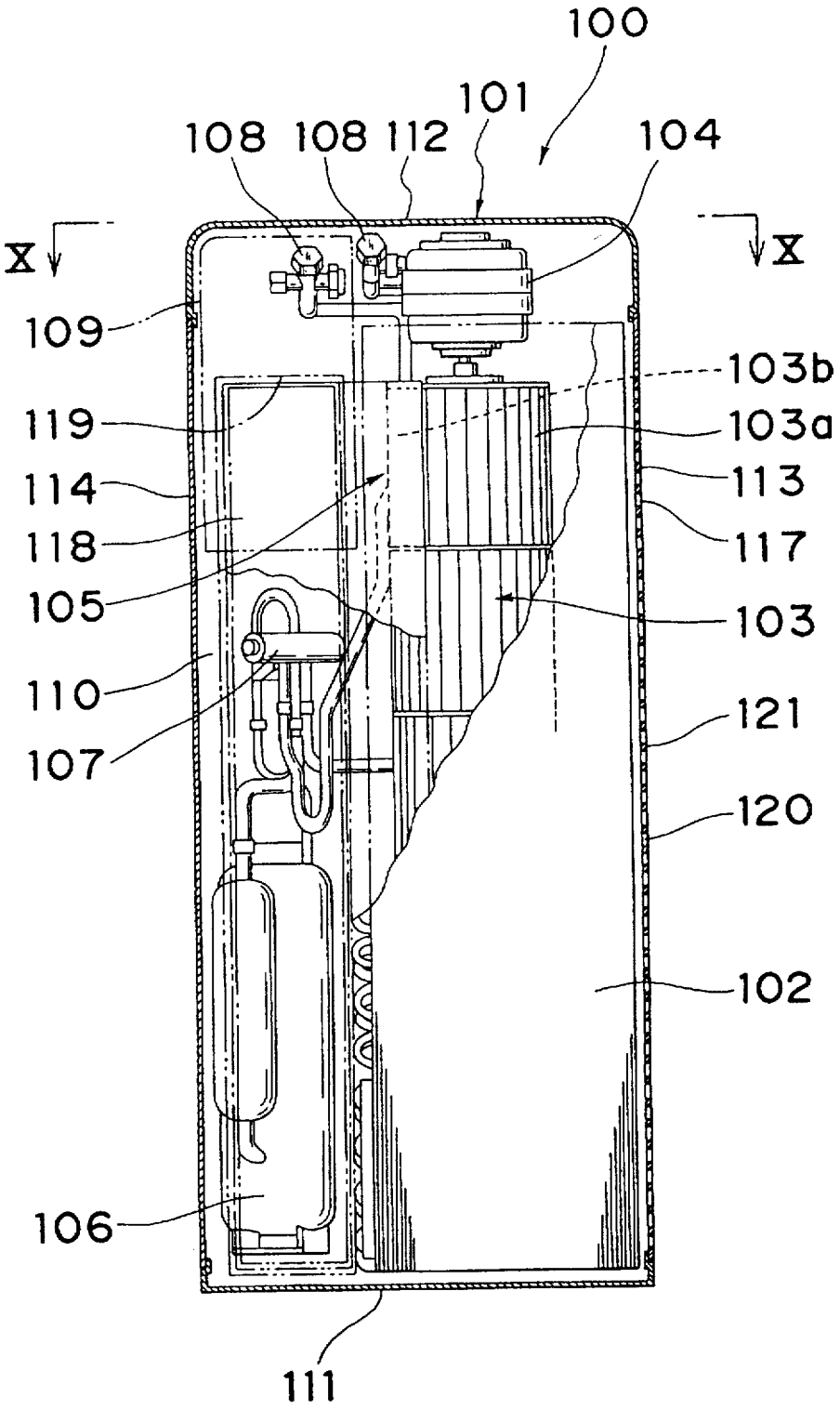
FIG. 9 is a longitudinal sectional view of an air conditioner outdoor unit according to a second embodiment of the present invention.
Figure 10:
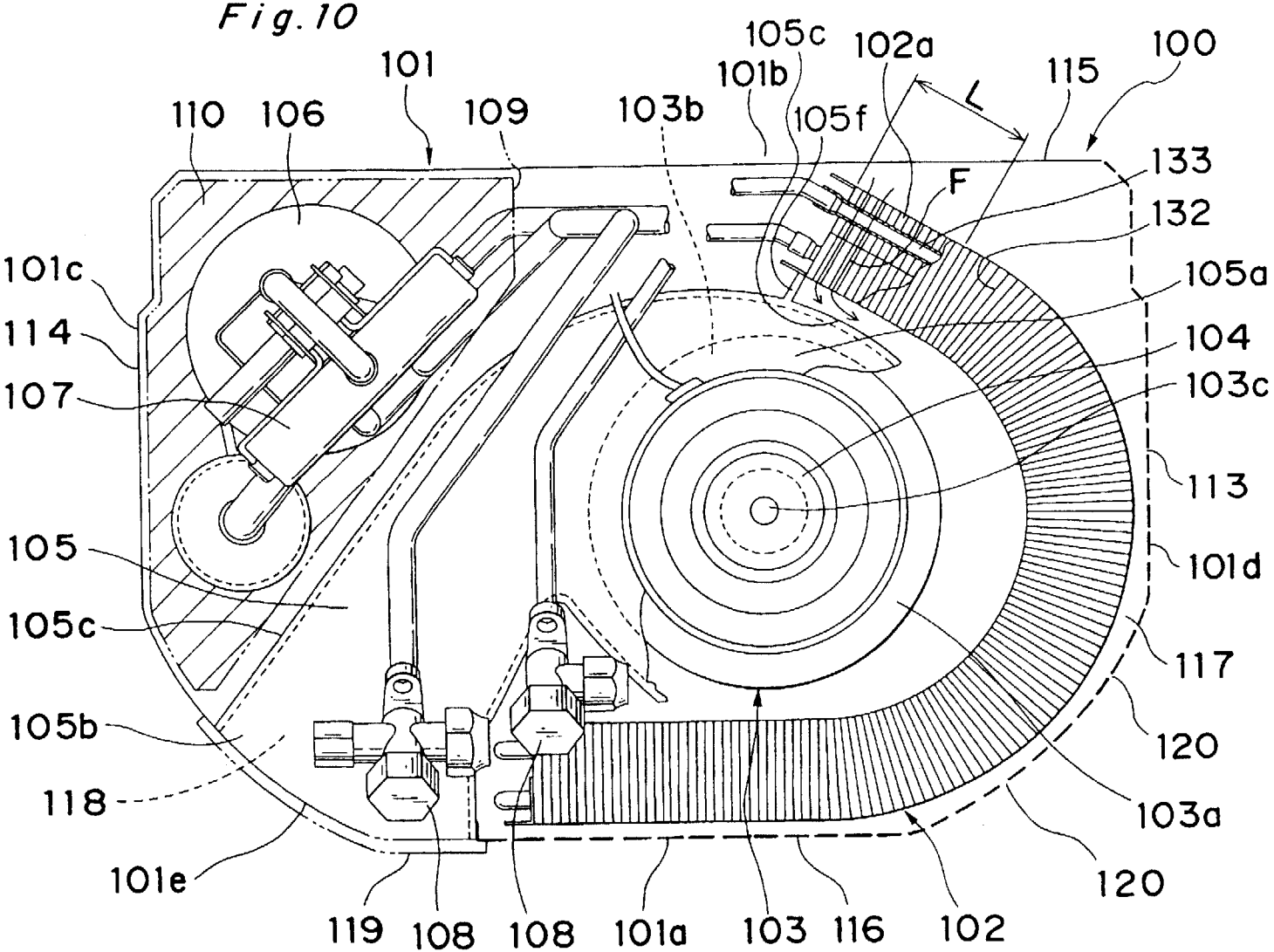
FIG. 10 is a sectional view taken along the line X—X in FIG. 9.

FIGS. 9 and 10 show an air conditioner outdoor unit 100 according to a second embodiment of the present invention. This outdoor unit 100 is an upright type outdoor unit constructed by arranging a heat exchanger 102, a cross flow fan 103 and so forth inside a casing 101.

The casing 101 has a vertically elongated configuration, and is provided with an approximately rectangular bottom plate 111 positioned at its lower end, a top plate 112 positioned at its upper end, a back plate 115 positioned on the rear surface side, a front plate 116 positioned on the front surface side, and left and right side plates 114 and 113 arranged between the back plate 115 and the front plate 116. In the present embodiment, the front plate 116 and one side plate 113 are implemented by a suction grill plate 121 comprised of one plate member provided with a number of ventilation holes 120, 120, . . . , and a portion corresponding to the suction grill plate 121 is made to serve as an inlet 117. Further, the other side plate 114 and a corner portion 101*e* of the front plate 116 of the casing 101 are made to serve as an outlet 118, and the outlet 118 is provided with a discharge grill 119.

The cross flow fan 103 is rotatively driven by a fan motor 104 provided at its axial end. The cross flow fan 103 is disposed in an approximately center position of the casing 101, the fan motor 104 is arranged in an upright state in an upper position of the casing 101. Outside a suction side 103*a* facing the inlet 117 of the cross flow fan 103 is provided the heat exchanger 102 formed as bent in an arc plate shape in a manner that it surrounds the periphery of the cross flow fan 103 located at the suction side 103*a*. Further, at a discharge side 103*b* opposite from the suction side 103*a* of the cross flow fan 103 is arranged a scroll 105 having a vertically elongated air passage extending along the entire length of the cross flow fan 103. In regard to this scroll 105, its inlet portion 105*a* is arranged as fitted on the peripheral surface at the discharge side 103*b* of the cross flow fan 103, while its outlet side 105*b* is opened at the outlet 118 of the casing 101.

When the scroll 105 is thus arranged between the discharge side 103*b* of the cross flow fan 103 arranged upright at the approximate center of the casing 101 and the outlet 118, a corner space 110 which has an approximately triangular cross section shape and extends inside the casing 101 from the lower end to the upper end of the casing is formed by the three members of the back plate 115 and the side plate 114 of the casing 101 and the peripheral surface of the scroll 105. This corner space 110 is originally an unused space inside the casing 101. However, in the present embodiment, by effectively utilizing the corner space 110, or the unused space, the height of the casing 101, i.e., the height of the outdoor unit 100 is suppressed low.

That is, the corner space 110 is used as a space for accommodating mechanisms, and a vertically elongated compressor 106 is placed at a lower portion of the corner space 110. Further, a four-way valve 107 connected to the compressor 106 via a piping is placed just above the compressor 106, and electric components 109 are further placed above the four-way valve 107 (i.e., at an upper portion of the corner space 110).

As described above, by securing a space for placing the compressor 106 beside the heat exchanger 102 and the cross flow fan 103 and placing the compressor 106 in this space, the compressor 106 is arranged vertically in parallel with the heat exchanger 102 and the cross flow fan 103 placed beside it. Therefore, in comparison with the case where the casing is made to have a vertical two-tier structure and the compressor is placed at the lower side of the cross flow fan and the heat exchanger as in the prior art, the height dimension of the casing 101, or the height dimension of the outdoor unit 100 can be suppressed low as much because no vertical space for placing the compressor inside the casing is required to be secured. As a result, while keeping the advantage of reducing the installation space in the horizontal planar direction attributed to the upright type outdoor unit employing the cross flow fan 103, a reduction of the installation space in the vertical direction can be further achieved. With this arrangement, the whole outdoor unit 100 is further compacted, and the stability of the outdoor unit 100 in regard to its external appearance is improved in the installed state by a degree corresponding to the reduction in height dimension of the outdoor unit 100, consequently improving the commercial value of the outdoor unit.

The compressor 106 having the greatest weight among the components of the outdoor unit 100 is arranged in a lower position of the corner space 110, i.e., in a lower position of the casing 101. Therefore, the center of gravity of the whole outdoor unit 100 is lowered, and this improves that much the stability of the outdoor unit 100 in terms of installation structure.

Furthermore, with the electric components 109 arranged in the upper position of the corner space 110, the electric components 109 and the fan motor 104 arranged in an upper position of the casing 101 are laterally put close to each other. Therefore, the length of the electric wiring to the fan motor 104 and the electric components 109 is reduced further than in the case where the fan motor and the electric components are separated far apart from each other, and this reduces that much the cost of the wiring in the outdoor unit 100.

Furthermore, in the present embodiment, as shown in FIG. 9, by placing shut-off valves 108 and 108 for a liquid refrigerant and a gas refrigerant beside the fan motor 104 placed at an upper portion of the casing 101, i.e., in the unused space formed in accordance with the arrangement of the fan motor 104 in an upper position of the casing 101, the shut-off valves 108 and 108 are put in the casing 101 together with the other components to constitute the fully integrated outdoor unit 100. Therefore, the shut-off valves 108 are not exposed to the outside of the casing 101 in comparison with the case where the shut-off valves are exposed and arranged in an upper position of the casing as in the prior art, and the outward appearance of the outdoor unit 100 improves that much, consequently improving the commercial value of the outdoor unit 100. Furthermore, with the reduction of the vertical position of the shut-off valves 108, when performing a pipe connecting work for the shut-off valves 108, the operator can perform this work in a standing posture. Therefore, in comparison with the case where the work is performed by using, for example, a stepladder, the work can be performed more easily, consequently improving the working efficiency that much.

Furthermore, as shown in FIG. 10, the heat exchanger 102 has a structure that a plurality of pipes 133 are penetrating a plurality of plate fins 132. The plate fins 132 are arranged in parallel with a rotary shaft 103*c* that extends in the vertical direction of the cross flow fan 103. Therefore, water drops attached to the plate fins 132 are smoothly guided downward along the surfaces extending in the vertical direction of the plate fins 132.

Furthermore, an end portion 102*a* of the heat exchanger 102 at the back plate 115 side is extended in a manner that it laps by a dimension L over the rear surface of an end portion 105*c* of the scroll 105 at the inlet portion 105*a* side and at the back plate 115 side. Therefore, intake air flowing as indicated by an arrow F undergoes heat exchange at the extended end portion 102*a* of the heat exchanger 102, so that the heat exchanging ability improves. It is to be noted that a wall portion 105*f* provided at the scroll 105 prevents the intake air from bypassing.

Figure 11:
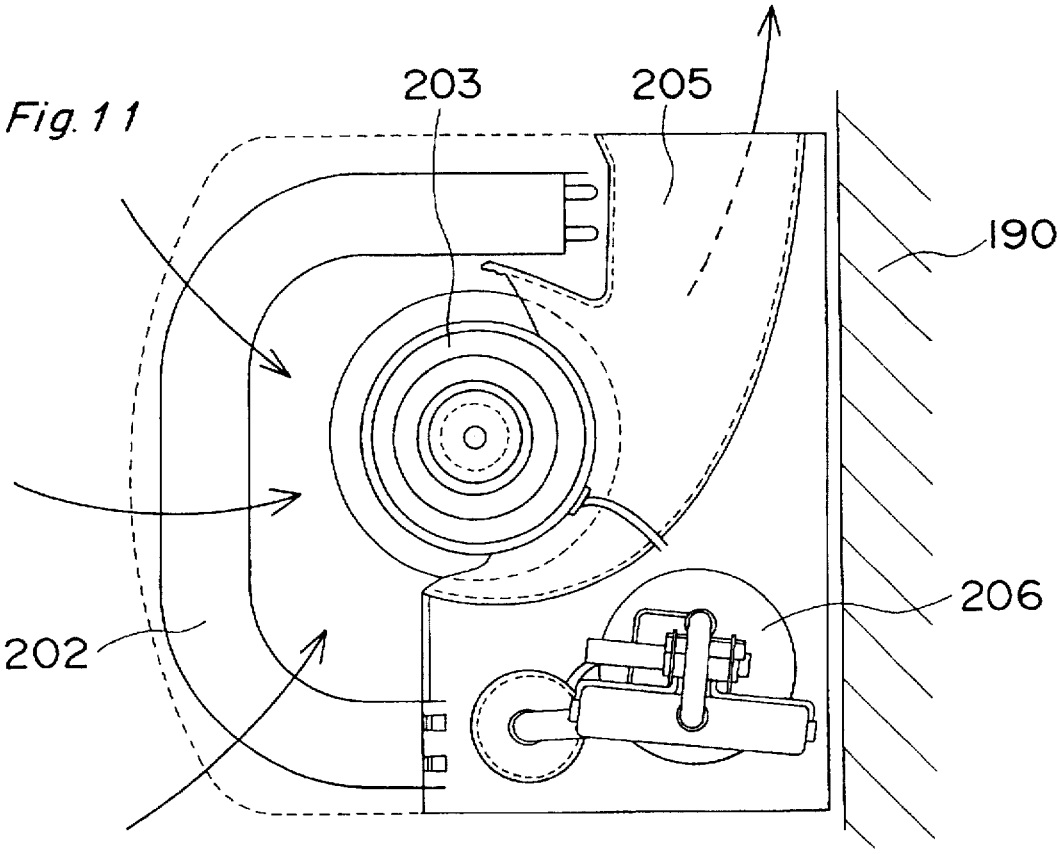
FIG. 11 is a transverse sectional view of a modification example of the second embodiment.

FIG. 11 is a transverse sectional view of a modification example of the second embodiment. The reference numeral 190 denotes a building wall. The reference numerals 202, 203, 205 and 206 denote an approximately J-shaped heat exchanger, a cross flow fan, a scroll and a compressor, respectively.

According to this outdoor unit, outside air is taken in from the left hand side toward a wall 196 as indicated by the arrows to exchange heat between the outside air and the refrigerant at the heat exchanger 202. Thereafter, the air is put through the cross flow fan 203 and then guided by the scroll 205 to be discharged rearward (upward in FIG. 11).

Figure 12:
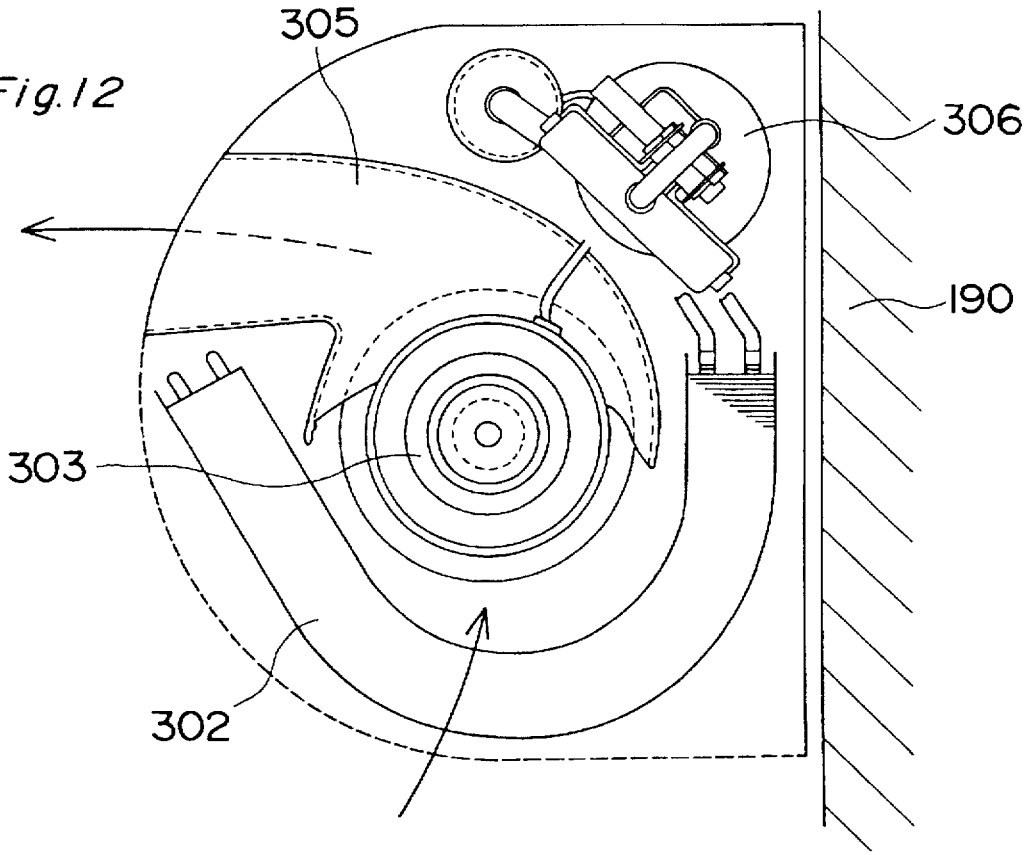
FIG. 12 is a transverse sectional view of another modification example of the second embodiment.

FIG. 12 is a transverse sectional view of another modification example of the second embodiment. The reference numeral 190 denotes a building wall. The reference numerals 302, 303, 305 and 306 denote an approximately U-shaped heat exchanger, a cross flow fan, a scroll and a compressor, respectively.

According to this outdoor unit, outside air taken in from the left hand side and from in front as indicated by the arrow is put through the heat exchanger 302 and the cross flow fan 303 and further guided by the scroll 305 to be discharged leftward. It is to be noted that the direction of the outgoing discharge air is deflected, for example, upward so that the incoming outside air and the outgoing discharge air do not short-circuit each other.

INDUSTRIAL APPLICABILITY

As described above, the air conditioner outdoor unit of the present invention is appropriate for use in an apartment house or the like having a narrow installation space.

What is claimed is:

1. An air conditioner outdoor unit comprising:

a housing including front and rear walls and side walls joining the front and rear walls;

a cross-flow fan having a generally cylindrical periphery disposed within the housing, the rotational axis of the fan being disposed generally parallel to joints formed between the front and rear walls and the side walls;

a heat exchanger disposed within the housing, the heat exchanger being curved so as to surround a first region of the cylindrical periphery of the fan;

air intake means forming an air intake to the first region of the fan extending through the front wall and through the heat exchanger;

air discharge means forming an air discharge passage from a second region of the fan, the air discharge means comprising a scroll wall which forms, with a side wall and the rear wall, a first housing compartment;

a compressor disposed within the housing; and at least one refrigerant conduit connected to the compressor and extending through the first housing compartment.

2. An air conditioner outdoor unit as claimed in claim 1, wherein the first housing compartment is of approximately triangular cross sectional shape.

3. An air conditioner outdoor unit as claimed in claim 1, wherein the heat exchanger has a plurality of plate fins, the plate fins each have a surface parallel to the rotational axis of the fan, and the plurality of plate fins are arranged substantially radially relative to the fan.

4. An air conditioner outdoor unit as claimed in claim 1, wherein the compressor and a heat exchange unit, including the fan and the heat exchanger, are arranged one above the other in two tiers.

5. An air conditioner outdoor unit as claimed in claim 1, wherein a heat exchange unit, including the heat exchanger and the fan, is arranged alongside the compressor.

6. An air conditioner outdoor unit as claimed in claim 1, wherein an end portion of the heat exchanger faces an outside surface of an inlet side portion of the scroll wall.

7. An air conditioner outdoor unit as claimed in claim 4, wherein the heat exchange unit is disposed above a machine room unit, including the compressor, a shut-off valve is provided at an upper portion of the heat exchange unit, and the refrigerant conduit extends from the machine room unit to the shut-off valve through the first housing compartment.

8. An air conditioner outdoor unit as claimed in claim 5, wherein a shut-off valve is provided at an upper portion of the heat exchange unit, and the refrigerant conduit extends from the compressor to the shut-off valve through the first housing compartment.

9. An air conditioner outdoor unit as claimed in 1, wherein a motor for the fan is provided at the upper portion of the heat exchange unit, including the heat exchanger and the fan, air outlet from the air discharge passage opens obliquely upwardly, and air outlet louvers, are arranged in parallel with one another at the air outlet.

10. An air conditioner outdoor unit as claimed in claim 4, and further comprising a machine room unit, including the compressor, and wherein the machine room unit and the heat exchange unit are arranged one above the other and each unit is disposed in a casing having substantially the same transverse cross sectional shape so as to be integrated with each other.

11. An air conditioner outdoor unit as claimed in claim 5, wherein the compressor is disposed in the first housing compartment.

12. An air conditioner outdoor unit as claimed in claim 1, wherein a shut-off valve is provided at an upper portion of a heat exchange unit, including the heat exchanger and the fan, and a duct which can accommodate a pipe is connected to an upper portion of the housing.

13. An air conditioner outdoor unit as claimed in claim 1, wherein a shut-off valve is provided at an upper portion of heat exchange unit, including the heat exchanger and the fan, and an extension casing having a transverse cross section shape, which is the same as the transverse cross section shape of the housing, is disposed above and connected to the housing, and a pipe is arranged through the extension casing.

* * * * *